US011778365B2

(12) United States Patent
Lu et al.

(10) Patent No.: US 11,778,365 B2
(45) Date of Patent: Oct. 3, 2023

(54) EARPHONE HAVING ADJUSTABLE MICROPHONE

(71) Applicant: DEXIN CORP., New Taipei (TW)

(72) Inventors: Ho Lung Lu, New Taipei (TW); Ya-Hsiu Tsai, New Taipei (TW)

(73) Assignee: DEXIN CORP., New Taipei (TW)

( * ) Notice: Subject to any disclaimer, the term of this patent is extended or adjusted under 35 U.S.C. 154(b) by 232 days.

(21) Appl. No.: 17/513,872

(22) Filed: Oct. 28, 2021

(65) Prior Publication Data

US 2023/0063619 A1 Mar. 2, 2023

(30) Foreign Application Priority Data

Aug. 30, 2021 (TW) ..... 110132134

(51) Int. Cl.

| | |
|---|---|
| ***H04R 1/10*** | (2006.01) |
| ***H04R 5/033*** | (2006.01) |
| ***H04R 1/08*** | (2006.01) |

(52) U.S. Cl.

CPC ..... *H04R 1/1075* (2013.01); *H04R 1/08* (2013.01); *H04R 1/1016* (2013.01); *H04R 5/033* (2013.01); *H04R 2201/107* (2013.01)

(58) Field of Classification Search

CPC ..... H04R 1/08; H04R 1/083; H04R 1/1091; H04R 1/14; H04R 2201/107; H04R 2210/10

See application file for complete search history.

(56) References Cited

FOREIGN PATENT DOCUMENTS

| | | | | |
|---|---|---|---|---|
| EP | 2744221 A1 * | 6/2014 | ..... | H04R 1/02 |
| EP | 3300385 A2 * | 3/2018 | ..... | H04R 1/083 |

* cited by examiner

*Primary Examiner* — Kile O Blair
(74) *Attorney, Agent, or Firm* — Maschoff Brennan

(57) ABSTRACT

An earphone includes a main body and a movable component. The main body accommodates a first built-in microphone and a second built-in microphone therein. The movable component accommodates a third built-in microphone therein. The movable component is movably disposed on the main body and has a stored position and a sticking out position. When the movable component is in the stored position, the main body activates the first built-in microphone and the second built-in microphone and deactivates the third built-in microphone. When the movable component is in the at least one sticking out position, the third built-in microphone is located relatively away from the main body, and the main body deactivates one of the first built-in microphone and the second built-in microphone and activates the third built-in microphone.

10 Claims, 3 Drawing Sheets

EARPHONE HAVING ADJUSTABLE MICROPHONE

CROSS-REFERENCE TO RELATED APPLICATIONS

This non-provisional application claims priority under 35 U.S.C. § 119(a) on Patent Application No(s). 110132134 filed in Taiwan (R.O.C.) on Aug. 30, 2021, the entire contents of which are hereby incorporated by reference.

TECHNICAL FIELD

The disclosure relates to an earphone having an adjustable microphone.

BACKGROUND

Wireless earphones can bring a lot of conveniences as they set users free from any cables or wires. In addition to the basic needs such as listening to music, the earphone may have a built-in microphone for picking up voice.

Typically, the built-in microphone is still far away from the user's mouth when in use and thus is unable to have a quality voice pick-up but easily collect ambient noise.

SUMMARY

One embodiment of the disclosure provides an earphone includes a main body and a movable component. The main body accommodates a first built-in microphone and a second built-in microphone therein. The movable component accommodates a third built-in microphone therein. The movable component is movably disposed on the main body and has a stored position and a sticking out position. When the movable component is in the stored position, the main body activates the first built-in microphone and the second built-in microphone and deactivates the third built-in microphone. When the movable component is in the at least one sticking out position, the third built-in microphone is located relatively away from the main body, and the main body deactivates one of the first built-in microphone and the second built-in microphone and activates the third built-in microphone.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
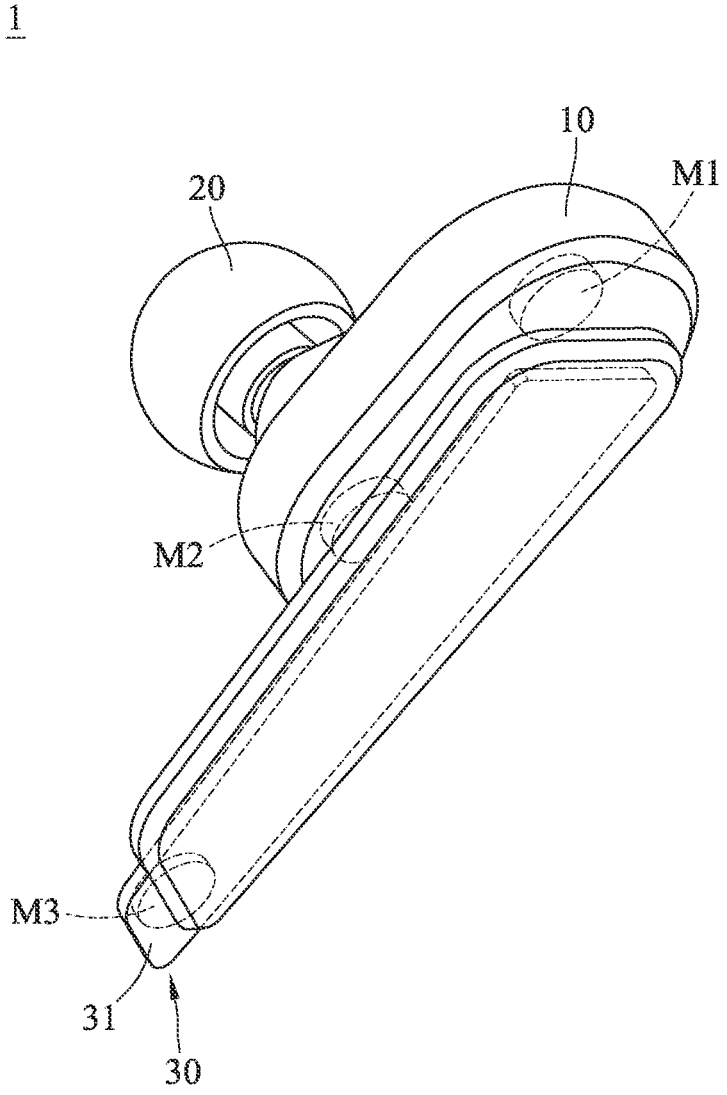
FIG. 1 is a perspective view of an earphone according to one embodiment of the disclosure.

The following embodiments will be described with reference to the drawings. For the purpose of clear illustration, some features shown in the drawings may be illustrated in a simplified manner or slightly exaggerated but are not intended to limit the disclosure. Unless explicitly stated, the term "at least one" as used herein may mean that the quantity of the described element or component is one or more than one but does not necessarily mean that the quantity is only one. The term "and/or" may be used herein to indicate that either or both of two stated possibilities.

Figure 2:
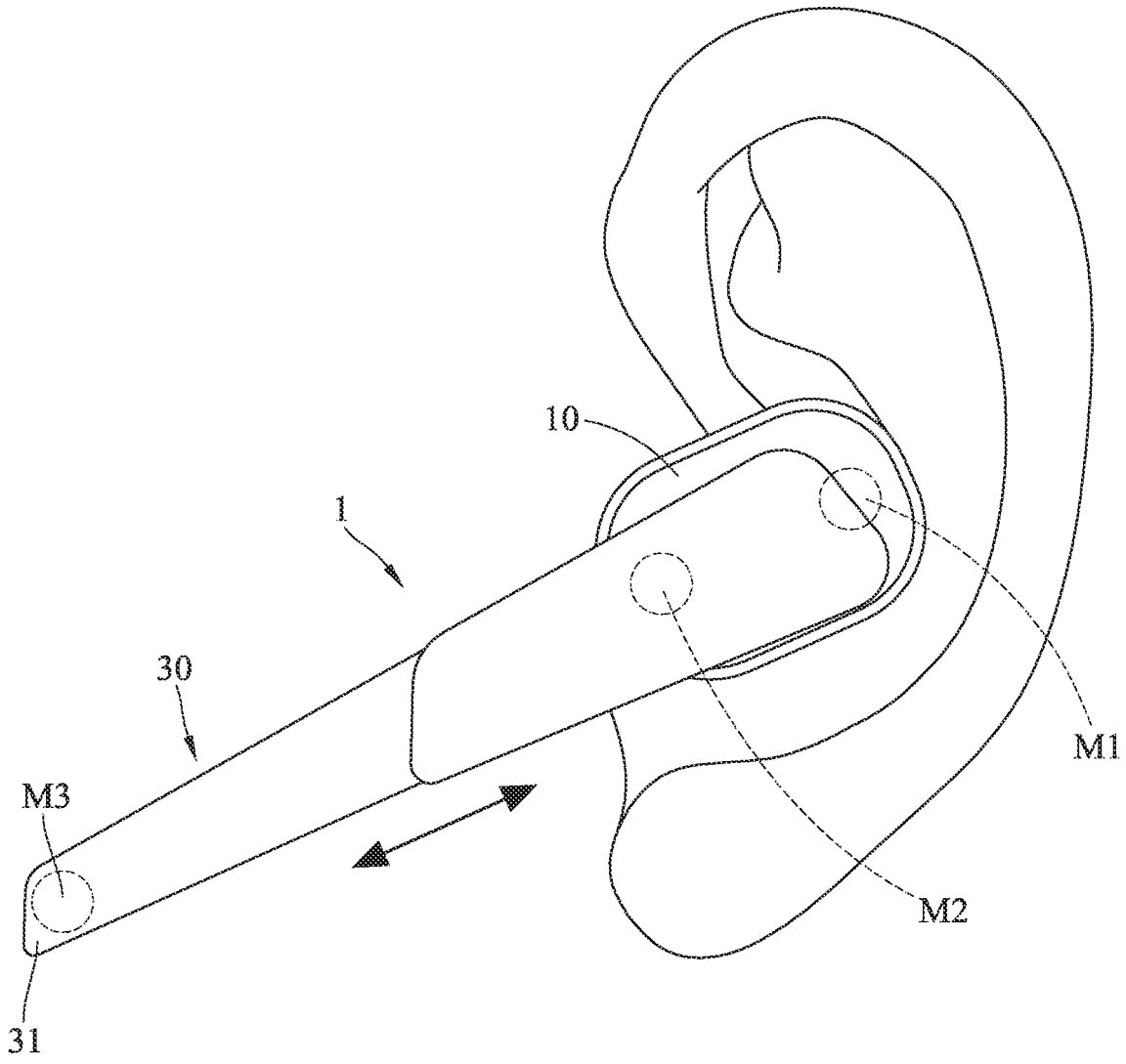
FIG. 2 depicts the operation of the earphone according to one embodiment of the disclosure.

Referring to FIGS. 1-2, an earphone 1 is provided, the earphone 1 may include a main body 10 and a movable component 30. In addition, the earphone 1 may further include an in-ear eargel 20.

The main body 10 is, but not limited to, the right or left audio device of a true wireless stereo (TWS) Bluetooth earphone. The term "TWS" or "True wireless stereo" refers to a technology that allows two audio devices to be paired via Bluetooth, realizing the wireless separation of real Bluetooth left and right sound channels.

The in-ear eargel 20 is attached or connected to one side of the main body 10. The in-ear eargel 20 is made of, for example, silicone, sponge, urethane, or the like and is shaped and sized to be insertable in the external ear canal. Note that the shape, size, and the material of the in-ear eargel 20 all may be modified as required and are not intended to limit the disclosure. In another embodiment, the earphone may omit the in-ear eargel; in this case, part of the main body may be sized and shaped to be insertable in the external ear canal.

The main body 10 may have a plurality of built-in microphones to pick up voice in different directions. As shown, in this embodiment, the main body 10 accommodates a first built-in microphone M1 and a second built-in microphone M2, the first built-in microphone M1 and the second built-in microphone M2 may be any suitable built-in microphone used in typical earphone. The first built-in microphone M1 and the second built-in microphone M2 may be respectively arranged close to two opposite ends of the main body 10 to pick up voice in different directions. When the earphone 1 is in use, the first built-in microphone M1 is located relatively away from the user's mouth and can be used to filter out the surrounding noise, the second built-in microphone M2 is located relatively close to the user's mouth to pick up the user's voice, and their cooperation help achieve noise suppression.

The movable component 30 is slidably disposed on the main body 10 and therefore has a stored position (as shown in FIG. 1) and a sticking out position (as shown in FIG. 2). In this embodiment, as shown in FIG. 1, the movable component 30 is in a flat shape and can be stored in the inner side of the main body 10 when in the stored position. The inner side of the main body 10 means the side of the main body 10 faces towards the user's face when the user wears the earphone 1. As shown, when movable component 30 is in the stored position, the main body 10 almost or nearly covers the whole of the movable component 30. In other words, when the movable component 30 is in the stored position, the movable component 30 may be hidden behind the main body 10.

In this embodiment, the movable component 30 may have a third built-in microphone M3. The third built-in microphone M3 may be arranged in a distal end 31 of the movable component 30. The third built-in microphone M3 may be any suitable built-in microphone used in typical earphone. The distal end 31 indicates the part or area of the movable component 30 that is located away from the main body 10. The movable component 30 enables the position adjustment of the third built-in microphone M3 and therefore enables the mode switching of the earphone 1.

Specifically, when the movable component 30 is in the stored position, the first built-in microphone M1 and the second built-in microphone M2 are activated and the third built-in microphone M3 is deactivated. That is, when the movable component 30 is in the stored position, the earphone 1 mainly relies on the microphones within the main body 10 (i.e., the first built-in microphone M1 and the second built-in microphone M2) to collect voice. Then, as shown in FIG. 2, when the movable component 30 is moved to the sticking out position to make the distal end 31 move further away from the main body 10 by a proper distance, the third built-in microphone M3 within the distal end 31 of the movable component 30 is located closer to the user's mouth. In response to the position switching of the movable component 30, the third built-in microphone M3 is activated and the second built-in microphone M2 is deactivated. That is, when the movable component 30 is in the sticking out position, the earphone 1 mainly relies on the first built-in microphone M1 and the third built-in microphone M3 to collect voice. In other words, when the movable component 30 is switched to the sticking out position, the third built-in microphone M3 may replace the function of the second built-in microphone M2. At that moment, the cooperation of the first built-in microphone M1 and the third built-in microphone M3 helps achieve noise suppression as well. Also, when the movable component 30 is in the sticking out position, the third built-in microphone M3 is located much closer to the user's mouth than the second built-in microphone M2, which facilitates the third built-in microphone M3 to obtain a better quality voice pick-up from the user's voice.

Note that the aforementioned built-in microphones can respond to the position switching of the movable component via any suitable manner, such as internal wiring or wireless communication. Note that the position and quantity of the aforementioned built-in microphones may be modified as required. Note that any suitable mechanism which can stably keep the movable component in the required position, enable a stepless fine adjustment of the movable component or multi-sticking-out position of the movable component with respect to the main body can be employed to the movable component and the main body.

It is also noted that the movable component may be disposed on the main body in other manners. For example, please see an earphone 1' in FIG. 3, the main difference between the earphone 1' and the earphone 1 of the previous embodiment is that the movable component 30 of the earphone 1' is pivotably connected to the main body 10 at one end thereof. As shown, the movable component 30 is pivotable about an axis AX with respect to the main body 10 so as to be switchable between the stored position and the sticking out position.

Figure 3:
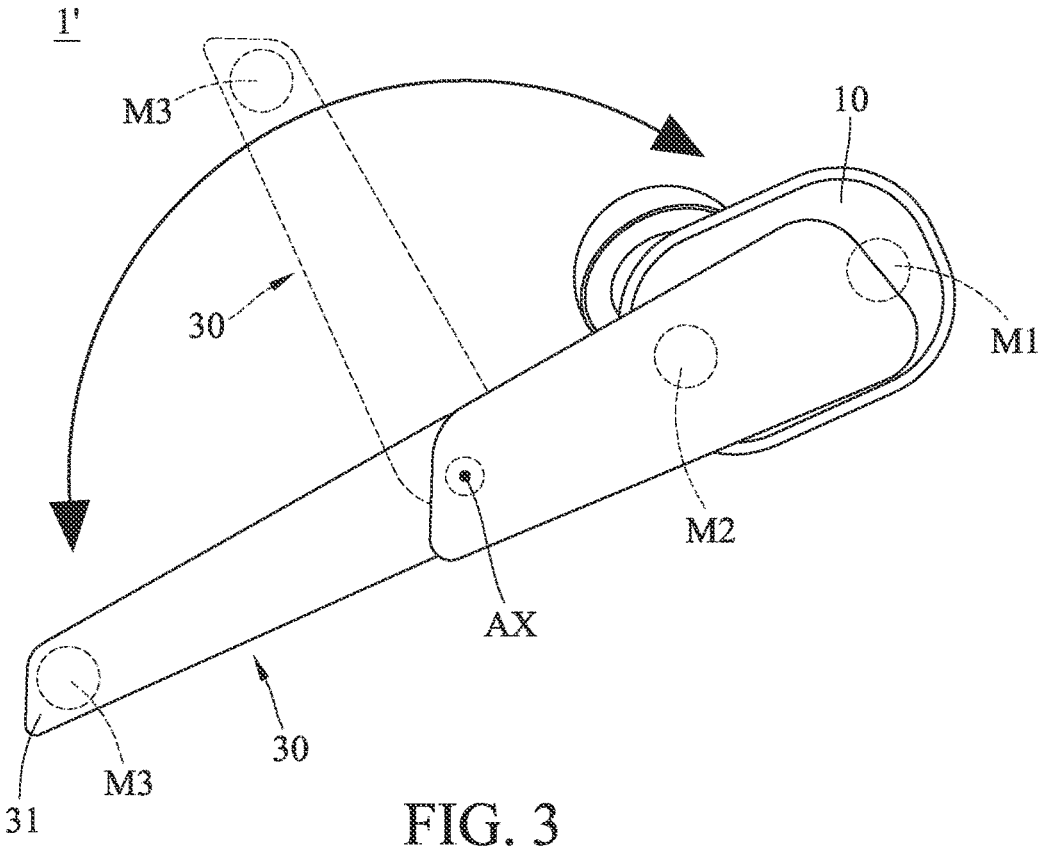
FIG. 3 depicts the operation of an earphone according to another embodiment of the disclosure.
Figure 4:
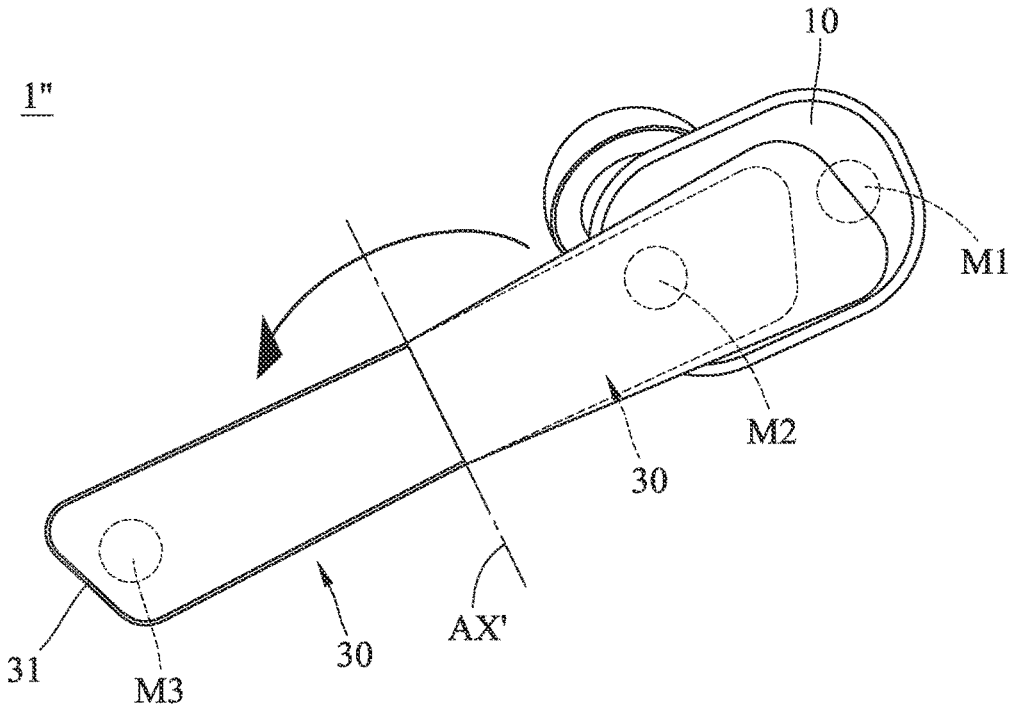
FIG. 4 depicts the operation of an earphone according to still another embodiment of the disclosure.

Alternatively, please see earphone 1" in FIG. 4, the main difference between the earphone 1" and the earphone 1' of the previous embodiment is that the movable component 30 of the earphone 1" is pivotably connected to the main body 10 at one end thereof, and an axis AX' of the movable component 30 is substantially perpendicular to the axis AX in FIG. 3. Thus, the movable component 30 in FIG. 4 is foldable with respect to the main body 10.

According to the earphone as discussed in the above embodiments, the movable component on the main body is switchable between a stored position and at least one sticking out position, such that at least one of the built-in microphones can be moved towards the user's mouth to have a better quality voice pick up. Also, the built-in microphones within the movable component and the main body are able to respond to the position switching of the movable component, such that it is allowed to change the mode that the earphone collects voice by changing the position of the movable component.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. An earphone, comprising:

a main body, accommodating a first built-in microphone and a second built-in microphone therein; and a movable component, accommodating a third built-in microphone therein, wherein the movable component is movably disposed on the main body and has a stored position and a sticking out position;

when the movable component is in the stored position, the main body activates the first built-in microphone and the second built-in microphone and deactivates the third built-in microphone; when the movable component is in the at least one sticking out position, the third built-in microphone is located relatively away from the main body, and the main body deactivates one of the first built-in microphone and the second built-in microphone and activates the third built-in microphone.

2. The earphone according to claim 1, wherein the third built-in microphone is accommodated within a distal end of the movable component.

3. The earphone according to claim 1, wherein when the movable component is in the stored position, the movable component is stored at inner side of the main body.

4. The earphone according to claim 1, wherein the first built-in microphone and the third built-in microphone respectively face towards different directions.

5. The earphone according to claim 1, wherein the main body is a left audio device or a right audio device of a true wireless stereo Bluetooth earphone.

6. The earphone according to claim 1, wherein when the movable component is in the stored position, the main body completely covers the movable component.

7. The earphone according to claim 1, wherein the movable component is in a flat shape.

8. The earphone according to claim 1, wherein the movable component is slidably disposed on the main body.

9. The earphone according to claim 1, wherein the movable component is pivotably disposed on the main body.

10. The earphone according to claim 1, wherein the movable component is foldable with respect to the main body.

* * * * *